US009974382B2

(12) United States Patent
Lin

(10) Patent No.: US 9,974,382 B2
(45) Date of Patent: May 22, 2018

(54) CLEANING BRUSH ASSEMBLY

(71) Applicant: Yu-Ching Lin, Chia-Yi (TW)

(72) Inventor: Yu-Ching Lin, Chia-Yi (TW)

( * ) Notice: Subject to any disclaimer, the term of this patent is extended or adjusted under 35 U.S.C. 154(b) by 244 days.

(21) Appl. No.: 15/080,463

(22) Filed: Mar. 24, 2016

(65) Prior Publication Data

US 2017/0273449 A1 Sep. 28, 2017

(51) Int. Cl.

| | |
|---|---|
| ***B08B 1/00*** | (2006.01) |
| ***B08B 9/023*** | (2006.01) |
| ***A46B 9/02*** | (2006.01) |
| ***A46B 13/00*** | (2006.01) |
| ***B08B 9/02*** | (2006.01) |
| *B08B 1/04* | (2006.01) |

(52) U.S. Cl.

CPC ..... *A46B 13/001* (2013.01); *A46B 9/02* (2013.01); *B08B 1/002* (2013.01); *B08B 9/021* (2013.01); *B08B 9/023* (2013.01); *A46B 2200/3013* (2013.01); *B08B 1/04* (2013.01)

(58) Field of Classification Search

CPC ..... A46B 7/04; A46B 7/042; A46B 7/044; A46B 9/00; A46B 9/02; A46B 9/025; A46B 9/026; A46B 9/028; A46B 13/00; A46B 13/001; A46B 13/02; A46B 13/08; A46B 15/00; A46B 2200/30; A46B 2200/3013; A46B 2200/3073; A46B 2200/3093; B08B 1/00; B08B 1/002; B08B 1/04; B08B 9/021; B08B 9/023

USPC ..... 15/88, 104, 4, 160, 179, 202

See application file for complete search history.

(56) References Cited

U.S. PATENT DOCUMENTS

| | | | | | |
|---|---|---|---|---|---|
| 1,710,127 | A * | 4/1929 | Vaughn | H01M 2/30 | 15/104.011 |
| 1,838,958 | A * | 12/1931 | Page | A46B 9/02 | 15/106 |
| 3,188,674 | A * | 6/1965 | Hobbs | A46B 7/04 | 15/104.04 |
| 4,301,567 | A * | 11/1981 | Tucker | A46B 7/04 | 15/104.04 |
| 5,566,416 | A * | 10/1996 | Karls | A46B 9/02 | 15/104.04 |
| 6,553,601 | B1 * | 4/2003 | Major | A46B 13/001 | 15/104.04 |
| 6,769,151 | B1 * | 8/2004 | Lin | A46B 13/001 | 15/104.04 |
| 2004/0031112 | A1 * | 2/2004 | Saurer | A46B 13/001 | 15/88 |
| 2006/0112506 | A1 * | 6/2006 | Smart | A46B 13/001 | 15/88 |
| 2009/0235470 | A1 * | 9/2009 | Moisides | A46B 13/001 | 15/21.1 |

(Continued)

FOREIGN PATENT DOCUMENTS

GB 1031561 * 6/1966

*Primary Examiner* — Mark Spisich
(74) *Attorney, Agent, or Firm* — Symbus Law Group, LLC; Clifford D. Hrya

(57) ABSTRACT

A cleaning brush assembly includes a housing, a cylindrical brush received in the housing, and a fixing member for fixing the cylindrical brush in the housing. By providing the above structure, the cleaning brush assembly can rapidly clean rusts on a battery cathode terminal, a battery anode terminal, or a bolt on a vehicle wheel disc while permitting easy replacement of the cylindrical brush.

2 Claims, 2 Drawing Sheets

(56) References Cited

U.S. PATENT DOCUMENTS

| | | | | |
|---|---|---|---|---|
| 2010/0263145 | A1* | 10/2010 | Chen | A46B 5/0095 15/160 |
| 2011/0005012 | A1* | 1/2011 | Le Blanc | A46B 13/001 15/21.1 |

* cited by examiner

CLEANING BRUSH ASSEMBLY

BACKGROUND OF THE INVENTION

The present invention relates to a cleaning brush assembly and, more particularly, to a cleaning brush assembly for cleaning rusts on a battery cathode terminal, a battery anode terminal, or a bolt on a vehicle wheel disc.

The cathode terminals, anode terminals and cable ends of batteries rust after a period of time of use, resulting in poor contact and poor conductivity. Furthermore, bolts on vehicle wheel discs are apt to rust after long-term use, failing to provide tightening between the bolts and nuts and, hence, adversely affecting the driving safety.

Applicant's U.S. Pat. No. 6,769,151 B1 discloses a scarifying and deburring tool for cleaning the rusts on the above objects. The scarifying and deburring tool includes a body, a handle, and a scarifying brush. A fixing block and a cylindrical deburring scraper are mounted in the body. The fixing block includes a fixing hole defined in an outer periphery thereof and aligned with a fixing hole of the body. A fastener extends through the fixing holes to fix the fixing block and the body. The fixing block includes a screw hole for coupling with a threaded section of the scarifying brush or a connecting rod. By such an arrangement, a battery cathode terminal, a battery anode terminal, or a bolt on a vehicle wheel disc can be placed into the cylindrical deburring scraper, and the body can be manually turned to clean the rusts with the bristles on the cylindrical deburring scraper. Alternatively, the threaded section of the connecting rod is coupled with the screw hole of the fixing block, and the other end of the connecting rod is connected to an electric tool, permitting rapid rotation by using the electric tool, thereby rapidly cleaning the rusts with the bristles on the cylindrical deburring scraper.

However, when the cylindrical deburring scraper is to be replaced, the fastener for fixing the fixing block and the body must be detached by a screwdriver to detach the fixing block from the body. Furthermore, after replacement of a cylindrical deburring scraper that is new or that has a different size, it is difficult to align the fixing hole of the fixing block with the fixing hole of the body for subsequently extending the fastener through the fixing holes. Thus, the structure has drawbacks that should be improved.

BRIEF SUMMARY OF THE INVENTION

An objective of the present invention is to provide a cleaning brush assembly permitting easy replacement of the brush.

A cleaning brush assembly according to the present invention includes a housing, a cylindrical brush received in the housing, and a fixing member for fixing the cylindrical brush in the housing. The housing includes a cylindrical chamber and an open end in communication with the cylindrical chamber. An annular groove is defined in an inner periphery of the housing and located adjacent to the open end. An inner annular flange is formed on the inner periphery of the housing and located below the annular groove. A rib extends from the inner periphery of the housing towards the cylindrical chamber. The housing further includes at least one through-hole extending through the inner annular flange.

A width between an upper groove wall and a lower groove wall of the annular groove is slightly larger or equal to a width between an upper end face and a lower end face of the fixing member. The inner annular flange has an inner diameter smaller than a diameter of a section of the cylindrical chamber between the open end and an upper end face of the inner annular flange. A width between the upper end face of the inner annular flange and a lower end face of the annular groove is equal to a width between an upper end face and a lower end face of the cylindrical brush.

The rib includes an upper end face, a lower end face, a left end face, and a right end face. The upper end face of the rib extends downwards from the lower end face of the annular groove in the inner periphery of the housing to the upper end face of the inner annular flange. A width between the upper end face and the lower end face of the rib is equal to the width between the upper end face and the lower end face of the cylindrical brush.

The cylindrical brush includes a plate having a left end and a right end and a plurality of bristles on a side of the plate. The plate is bent to form a hollow cylinder. A length between the left end and the right end of the plate is slightly smaller than the inner diameter of the housing.

The fixing member includes a through-hole, a notch in communication with the through-hole, two insertion holes on two sides of the notch, an outer edge, and an inner edge. The outer edge of the fixing member is fixed in the annular groove of the housing. The inner edge of the fixing member is located outside of the annular groove of the housing. A lower end face at the inner edge of fixing member abuts the upper end face of the cylindrical brush. The lower end face of the cylindrical brush abuts the upper end face of the inner annular flange. An outer peripheral wall of the plate of the cylindrical brush abuts the inner periphery of the housing. The left end and the right end of the plate respectively abut the left end face and the right end face of the rib of the housing.

The other end of the housing opposite to the open end can include an engagement groove.

The present invention will become clearer in light of the following detailed description of illustrative embodiments of this invention described in connection with the drawings.

DETAILED DESCRIPTION OF THE INVENTION

Figure 1:
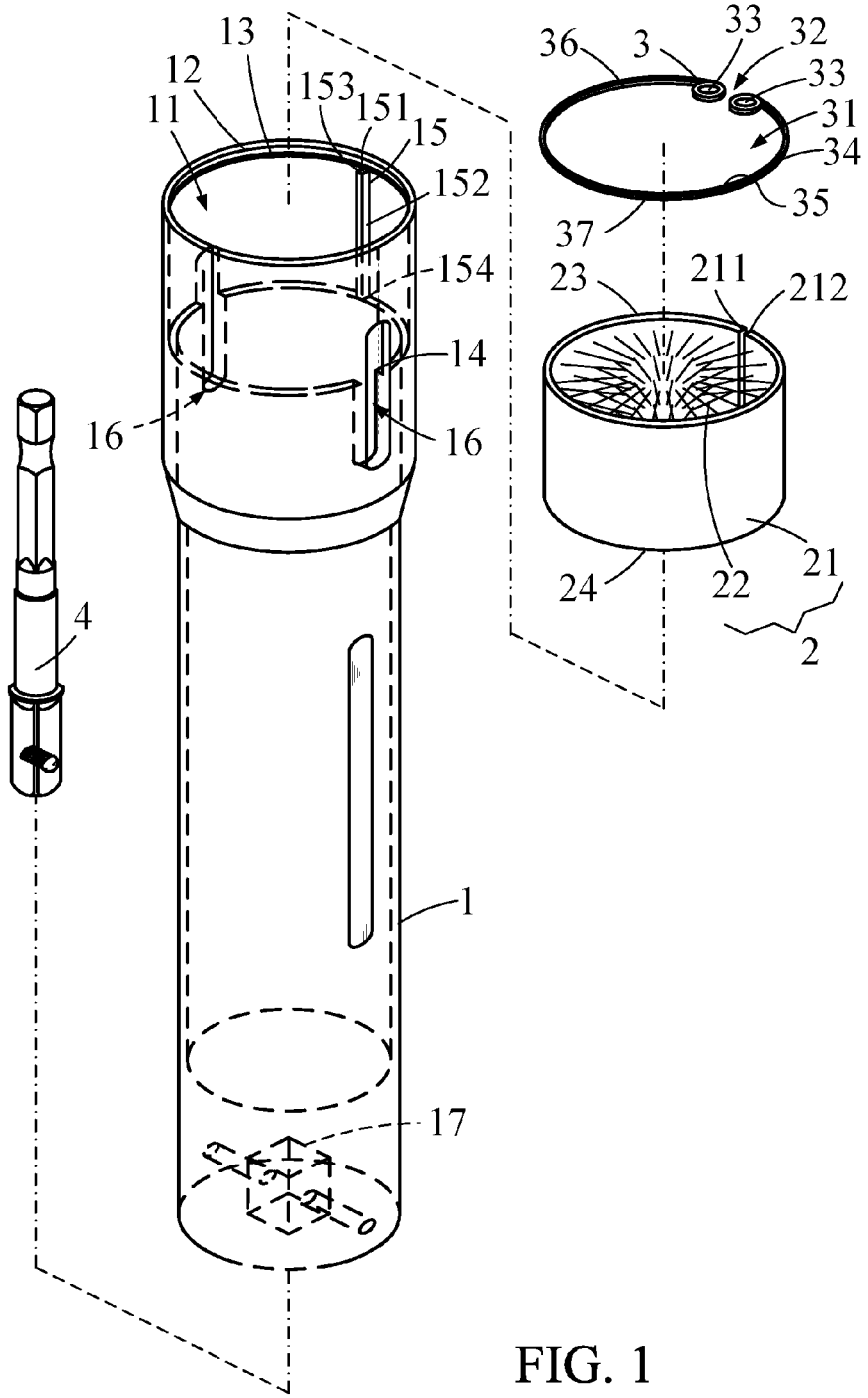
FIG. 1 is an exploded, perspective view of a cleaning brush assembly according to the present invention.
Figure 2:
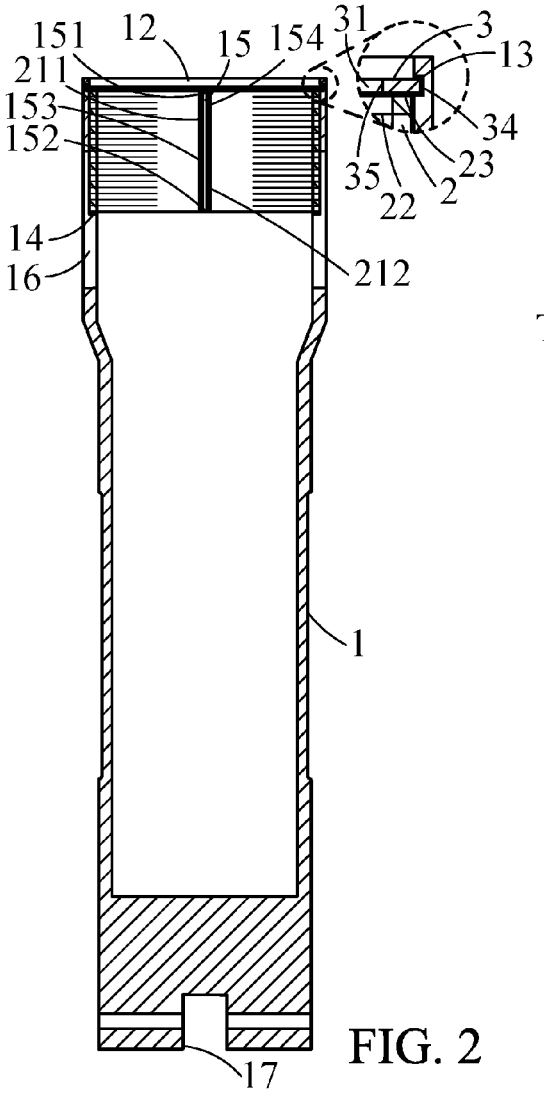
FIG. 2 is a cross sectional view of the cleaning brush assembly according to the present invention.
Figure 3:
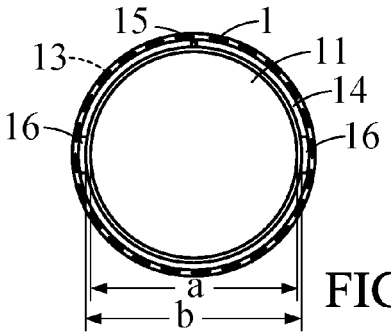
FIG. 3 is an upper view of a housing of the cleaning brush assembly according to the present invention.

With reference to FIGS. 1-3, a cleaning brush assembly according to the present invention includes a housing 1, a cylindrical brush 2 received in the housing 1, and a fixing member 3 for fixing the cylindrical brush 2 in the housing 1. The housing 1 includes a cylindrical chamber 11, an open end 12, an annular groove 13, an inner annular flange 14, a rib 15, and at least one through-hole 16. The open end 12 is located in an end of the housing 1 and is in communication with the cylindrical chamber 11. The cylindrical brush 2 and the fixing member 3 can be inserted into the cylindrical chamber 11 via the open end 12. The annular groove 13 is defined in an inner periphery of the housing 1 and is located adjacent to the open end 12. A width between an upper groove wall and a lower groove wall of the annular groove 13 is slightly larger or equal to a width between an upper end face 36 and a lower end face 37 of the fixing member 3. Thus, the fixing member 3 can be mounted into the annular groove 13.

The inner annular flange 14 is formed on the inner periphery of the housing 1 and is located below the annular groove 13 by an appropriate spacing. The inner annular flange 14 has an inner diameter a smaller than a diameter b of a section of the cylindrical chamber 11 between the open end 12 and an upper end face of the inner annular flange 14. A width between the upper end face of the inner annular flange 14 and a lower end face of the annular groove 13 is equal to a width between an upper end face 23 and a lower end face 24 of the cylindrical brush 2. The upper end face 23 of the cylindrical brush 2 received in the housing 1 abuts a lower end face 37 of fixing member 3, and the lower end face 24 of the cylindrical brush 2 abuts the upper end face of the inner annular flange 14, restricting the cylindrical brush 2 in the cylindrical chamber 11.

The rib 15 extends from the inner periphery of the housing 1 towards the cylindrical chamber 11. The rib 15 includes an upper end face 151, a lower end face 152, a left end face 153, and a right end face 154. The upper end face 151 of the rib 15 extends downwards from the lower end face of the annular groove 13 in the inner periphery of the housing 1 to the upper end face of the inner annular flange 14. A width between the upper end face 151 and the lower end face 152 of the rib 15 is equal to the width between the upper end face 23 and the lower end face 24 of the cylindrical brush 2.

The through-hole 16 extends through the inner annular flange 14 of the housing 1 in an appropriate location. A user can insert a tool T through the through-hole 16 and abuts the lower end face 24 of the cylindrical brush 2 in an appropriate location relative to the inner annular flange 14. Thus, the cylindrical brush 2 can be pressed by the tool T to move towards the open end 12, permitting easy replacement of the cylindrical brush 2, as shown in FIG. 4.

Figure 4:
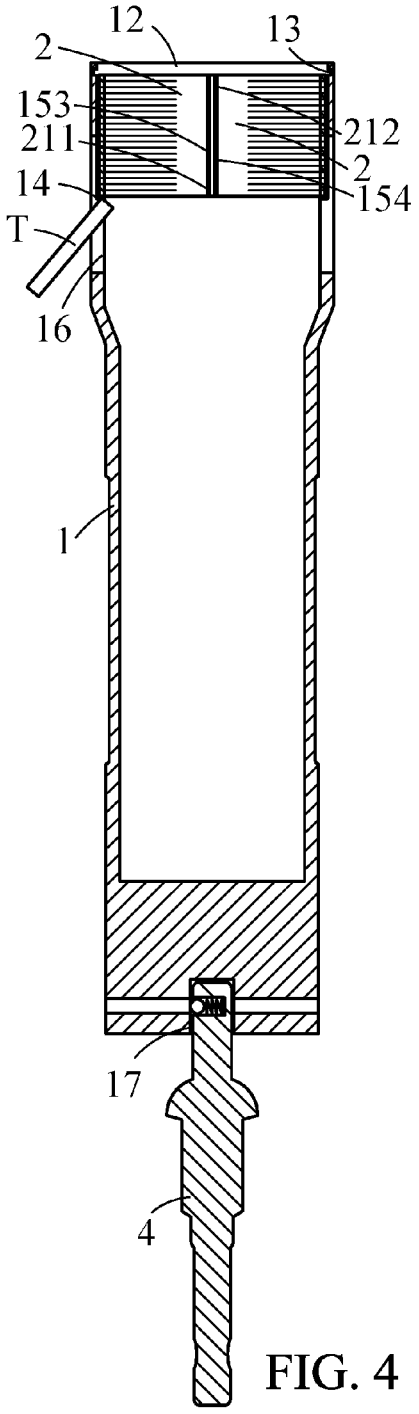
FIG. 4 is a cross sectional view of the cleaning brush assembly in use.

With reference to FIGS. 1 and 4, the housing 1 can further include an engagement groove 17 in the other end thereof opposite to the open end 12. The engagement groove 17 can be coupled with a coupler 4 of an electric tool or a manual tool.

With reference to FIG. 1, the cylindrical brush 2 is formed by a plate 21 made of a bendable material. As an example, a plurality of rows of metal bristles 22 if an identical length is fixed to a side of a rubber plate, and the rubber plate is bent to form a hollow cylinder. The plate 21 has a left end 211 and a right end 212. A length between the left end 211 and the right end 212 of the plate 21 is slightly smaller than the inner diameter of the housing 1. Thus, after having been bent to form the hollow cylinder, the cylindrical brush 2 is placed into the housing 1 via the open end 12. The lower end face 24 of the cylindrical brush 2 abuts the upper end face of the inner annular flange 14. The upper end face 23 of the cylindrical brush 2 abuts the lower end face 37 of the fixing member 3. An outer peripheral wall of the plate 21 of the cylindrical brush 2 abuts the inner periphery of the housing 1. Thus, vertical upward/downward movement of the cylindrical brush 2 in the housing 1 is avoided. The left end 211 and the right end 212 of the plate 21 respectively abut the left end face 153 and the right end face 154 of the rib 15 of the housing 1, preventing rotation of the cylindrical brush 2 in the housing 1.

With reference to FIG. 1, the fixing member 3 is made of a rigid material, such as a C-shaped plate made of plastic, stainless steel, or iron. The fixing member 3 includes a through-hole 31. A battery cathode terminal, a battery anode terminal, or a bolt on a vehicle wheel disc can be inserted through the through-hole 31. The fixing member 3 further includes a notch 32 in communication with the through-hole 31 and two insertion holes 33 on two sides of the notch 32. Due to provision of the notch 32, a user can insert two sharp ends of a pair of needle-nose pliers into the insertion holes 33 and can apply a force to move the insertion holes 33 toward each other, reducing the outer diameter of the fixing member 3, such that the fixing member 3 can be placed into the housing 1 via the open end 12. The outer edge 34 of the fixing member 3 is fixed in the annular groove 13 of the housing 1. The lower end face 37 at the inner edge 35 of the fixing member 3 is located outside of the annular groove 13 of the housing 1 for abutting the upper end face 23 of the cylindrical brush 2.

Since a battery cathode terminal, a battery anode terminal, or a bolt on a vehicle wheel disc can be inserted through the through-hole 31 and come into contact with the bristles 22 of the plate 21 of the cylindrical brush 2, when the user manually rotates the housing 1, the bristles 22 of the plate 21 of the cylindrical brush 2 received in the housing 1 can rapidly clean the rusts. Alternatively, when the engagement groove 17 of the housing 1 engages with the coupler 4 of an electric tool or a manual tool, the electric tool can be used to more rapidly clean the rusts, which is very useful.

When the user intends to mount or remove the fixing member 3 into or from the housing 1 via the open end 12, the user can reduce the outer diameter of the fixing member 3 by inserting two sharp ends of a pair of needle-nose pliers into the insertion holes 33 and applying a force to move the insertion holes 33 toward each other. Use of the cleaning brush assembly according to the present invention is easier than U.S. Pat. No. 6,769,151. The structure of the cleaning brush assembly according to the present invention is novel and provides effects that cannot be achieved by conventional structures, possessing an inventive step. Furthermore, the structure of the cleaning brush assembly according to the present invention is simple and can be used by the industry, possessing industrial applicability.

The present invention can be embodied by other forms without departing from the spirit and features thereof. For example, other than the insertion holes 33 on two sides of the notch 32 of the fixing member 3, hooks or columns can be disposed on two sides of the notch 32.

Although specific embodiments have been illustrated and described, numerous modifications and variations are still possible without departing from the scope of the invention. The scope of the invention is limited by the accompanying claims.

The invention claimed is:

1. A cleaning brush assembly comprising: a housing, a cylindrical brush received in the housing, and a fixing member for fixing the cylindrical brush in the housing, with the housing including a cylindrical chamber and an open end in communication with the cylindrical chamber, with an annular groove defined in an inner periphery of the housing and located adjacent to the open end, with an inner annular flange formed on the inner periphery of the housing and located below the annular groove, with a rib extending from the inner periphery of the housing towards the cylindrical chamber, with the housing further including at least one through-hole extending through the inner annular flange, with a width between an upper groove wall and a lower groove wall of the annular groove being slightly larger or equal to a width between an upper end face and a lower end face of the fixing member, with the inner annular flange having an inner diameter smaller than a diameter of a section of the cylindrical chamber between the open end and an upper end face of the inner annular flange, with a width between the upper end face of the inner annular flange and a lower end face of the annular groove being equal to a width between an upper end face and a lower end face of the cylindrical brush, with the rib including an upper end face, a lower end face, a left end face, and a right end face, with the upper end face of the rib extending downwards from the lower end face of the annular groove in the inner periphery of the housing to the upper end face of the inner annular flange, with a width between the upper end face and the lower end face of the rib being equal to the width between the upper end face and the lower end face of the cylindrical brush, with the cylindrical brush including a plate having a left end and a right end and a plurality of bristles on a side of the plate, with the plate bent to form a hollow cylinder, with a length between the left end and the right end of the plate being slightly smaller than the inner diameter of the housing, and with the fixing member including a through-hole, a notch in communication with the through-hole, two insertion holes on two sides of the notch, an outer edge, and an inner edge, with the outer edge of the fixing member fixed in the annular groove of the housing, with the inner edge of the fixing member located outside of the annular groove of the housing, with a lower end face at the inner edge of fixing member abutting the upper end face of the cylindrical brush, with the lower end face of the cylindrical brush abutting the upper end face of the inner annular flange, with an outer peripheral wall of the plate of the cylindrical brush abutting the inner periphery of the housing, and with the left end and the right end of the plate respectively abutting the left end face and the right end face of the rib of the housing.

2. The cleaning brush assembly as claimed in claim 1, with the housing including another end opposite to the open end, with the other end of the housing including an engagement groove.

* * * * *